US006854993B1

(12) United States Patent
McHugh et al.

(10) Patent No.: US 6,854,993 B1
(45) Date of Patent: Feb. 15, 2005

(54) IC SOCKET ASSEMBLY WITH IMPROVED HEAT SINK

(75) Inventors: Robert G. McHugh, Golden, CO (US); Yao-Chi Huang, Tu-Chen (TW); Hsiu-Yuan Hsu, Tu-chen (TW)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 10/751,808

(22) Filed: Jan. 5, 2004

(51) Int. Cl.[7] ..... H01R 4/60
(52) U.S. Cl. ..... 439/196; 439/487
(58) Field of Search ..... 439/196, 199, 439/487

(56) References Cited

U.S. PATENT DOCUMENTS 4,166,665 A * 9/1979 Cutchaw ..... 439/196
4,975,766 A * 12/1990 Umezawa ..... 257/714
5,854,738 A 12/1998 Bowler
6,449,157 B1 9/2002 Chu
6,466,443 B1 10/2002 Chen
6,497,582 B1 * 12/2002 Hoffmeyer ..... 439/71
2002/0023733 A1 * 2/2002 Hall et al. ..... 165/80.3

* cited by examiner

*Primary Examiner*—Ross Gushi
*Assistant Examiner*—James R. Harvey
(74) *Attorney, Agent, or Firm*—Wei Te Chung

(57) ABSTRACT

An integrated circuit (IC) socket assembly (1) includes an IC socket (4) mounted on a burn-in board (3) and receiving an IC (2) therein, a supporting member (5) assembled on the burn-in board and covering the IC socket, a heat sink (6) assembled on the supporting member, and an actuation member (7) assembled on the supporting member. The heat sink includes a jacket (61) attached on the IC. The jacket defines a U-shaped channel for containing cooling liquid therein. The actuation member is capable of being operated from an open position to a closed position, in which the jacket abuts against a top surface of the IC and the IC is reliably electrically connected with the burn-in board. During burning in, the jacket can quickly efficiently dissipate heat from the IC and associated components the protect the IC from instability and damage.

13 Claims, 7 Drawing Sheets

9

IC SOCKET ASSEMBLY WITH IMPROVED HEAT SINK

BACKGROUND OF THE INVENTION

1. Field of the Invention

The present invention relates to an integrated circuit (IC) socket assembly for electrically connecting an electronic package such as an IC with a circuit substrate such as a burn-in board, and more particularly to a heat sink used in an IC socket assembly for assisting in dissipating heat from the IC socket assembly, thereby protect an IC of the IC socket assembly and associated components from instability and damage.

2. Description of the Prior Art

Electronic packages, such as integrated circuits (ICs), are miniaturized electronic devices in which a number of active and passive circuit elements are located on or within a continuous body of material to perform the function of a complete circuit. To ensure reliability in use, the ICs require prior burning in to test their durability. The ICs are operated at high temperature for an extended period of time to accelerate potential failure points. This helps eliminate early product failures once the ICs are sold and/or assembled onto electronic end products. An IC socket is used to receive an IC therein, and to electrically connect the IC with a burn-in board for operation of the IC at high temperature. At the same time, a heat sink is attached onto a top surface of the IC. By removing heat from the IC, the heat sink protects the IC and associated components from instability and damage. A pertinent example of the IC socket assembly is disclosed in a co-pending U.S. patent application Ser. No. 10/630,591 filed on Jul. 29, 2003, assigned to the same assignee as that of the present invention.

Referring to FIG. 8, there is shown an exploded view of the IC socket assembly 9 with a heat sink 96. The IC socket assembly 9 comprises an IC socket 91 mounted on a burn-in board 92, an IC 913 attached in the IC socket 91, a supporting body 94, an actuation member 95, a heat sink 96, a securing member 97 and a supporting plate 98.

Also referring to FIG. 9, the supporting member 94 comprises a frame 940 and four columns 941 for supporting the frame 940. The frame 940 defines a rectangular window 942 in a middle portion thereof, and a pair of parallel channels 943 at opposite lateral sides of the frame 940 respectively next to the window 942. Four receiving holes 944 are defined in four corners of the frame 940 respectively, the receiving holes 944 corresponding to four bores 920 defined in the burn-in board 92. A passage 945 is defined in a portion between each channel 943 and the window 942, the passage 945 communicating with the window 942 and corresponding channel 943. Each column 941 defines a passageway 946 in a center thereof. The supporting plate 98 is generally rectangular configuration and defines four screw holes (not labeled), the screw holes corresponding to the bores 920 of the burn-in board 92. Four slotted screws 947 are inserted through the receiving holes 944 of the frame 940, the passageways 946 of the columns 941 and the bores 920 of the burn-in board 92, and turned to tightly engage in the screw holes of the supporting plate 98 respectively by a screwdriver (not shown), which increases the complexity of the operation, thereby tightly assembled the supporting member 94 and the supporting plate 98 onto the burn-in board 92. The supporting plate 98 can reinforce the burn-in board 92 to prevent the burn-in board 92 from being broken, but it increases the cost of the application.

The actuation member 95 comprises a pair of driving levers 951 and an operating lever 952 interconnecting ends of the driving levers 951. Each driving lever 951 forms a disk 953 on an end thereof. A screw hole 954 is defined in the disk 953, departing away a center of the disk 953. The disks 953 are accommodated in the channels 943 of the frame 940. Two screws 955 plug through the passages 945 of the frame 940 and engaged in the screw holes 954 of the disk 953, thereby securing the actuation member 95 to the frame 940. When being rotated from a first position to a second position, the actuation member 95 provides a desired force for the IC socket 91. When being rotated from the second position to the first position, the actuation member 95 attaches on the IC socket 91 freely. The IC 913 is electrically connected with the burn-in board 92 to operate the IC 913 at high temperature. However, in use, the actuation member 95 is liable to rotate with respect to the screws 955, which can loose the actuation member 95. Additionally, the friction between the screws 955 and the frame 940 increases difficulty of rotating the actuation member 95.

The heat sink 96 comprises a plurality of fins 960 extending upwardly, and a connection portion 961 formed in a center of the plurality of fins 960. The connection portion 961 defines four aligned blind hole (not labeled). The securing member 97 is generally "I"-shaped, and defined four blind holes (not shown) in a center thereof, corresponding to the blind holes of the connection portion 961. Four coil springs 970 are respectively received in the blind holes of the securing member 97 and the blind holes of the heat sink 96. The securing member 97 is assembled onto the frame 940 of the supporting member 94. Thus, the heat sink 96 is attached on a top surface of the IC 913 of the IC socket 91. When the IC 913 is electrically connected with the burn-in board 92 to operate the IC at high temperature, the heat sink 96 for dissipating heat from the IC 913 to protect it from instability and damage. However, in use, the heat sink can not quickly dissipate heat from the IC at the high temperature, which is liable to damage the IC 913.

In view of the above, a new IC socket assembly that overcomes the above-mentioned disadvantages is desired.

SUMMARY OF THE INVENTION

A main object of the present invention is to provide an integrated circuit (IC) socket assembly that includes a heat sink configured to facilitate quickly dissipating heat from an IC of the IC socket assembly, thereby efficiently protecting the IC and associated components from instability and damage.

Another object of the present invention is to provide an IC socket assembly with an actuation member, wherein the actuation member can be reliably operated to electrically connect an electronic package such as an IC with a substrate circuit such as a burn-in board, without any looseness during operation.

Further object of the present invention is to provide an IC socket assembly which can be manufactured at low cost and easily assembled.

To fulfill the objects, an IC socket assembly in accordance with a preferred embodiment of the present invention comprises an IC socket, a supporting member, a heat sink, and an actuation member. The IC socket is mounted on and electrically connected with a burn-in board. An IC is received in the IC socket. The supporting member is mounted on a top side of the burn-in board and covering the IC socket. The supporting member defines a window in a middle thereof, the IC exposed in the window. The heat sink comprises a generally rectangular frame assembled on the supporting member, a jacket attached on the IC in the window, and a spring engaging with the frame and abutting against a surface of the jacket. The actuation member comprises a pair of driving levers and an operating lever interconnecting with ends of the driving levers. Each driving lever is assembled onto the supporting member and forms a cam portion on an end thereof. The cam portions of the driving levers abut against the spring. The actuation member can be rotated from an open position to a closed position. In the closed position, the IC is reliably electrically connected with the burn-in board, and the whole assembly is operated at high temperature for an extended period of time to accelerate potential failure points.

Wherein the jacket defines a U-shaped channel with an entry and an exit. The channel is capable of containing cooling liquid such as water. Two pipes are joined with the entry and exit of the jacket respectively. During the burn-in, the liquid can be circulated, therefore the heat sink can quickly efficiently dissipate heat from the IC and associate components around the IC to protect them from instability and damage.

Wherein the cam portions of the actuation member is assembled on the supporting member by bolts mating in nuts, the actuation member can thus be reliably operated from the open position to the closed position without any looseness.

Wherein the supporting member is assembled onto the burn-in board by four thumb screws, which can be turned with thumb and finger, so as to decrease the difficulty of assembling the IC socket assembly onto the burn-in board.

Furthermore, the IC socket assembly includes a supporting plate assembled on a bottom side of the burn-in board to reinforce it. The supporting plate comprises a base portion and four extending portions extending from four corners of the base portion respectively. The base portion defines a rectangular open in a middle portion thereof, and each extending portion defines a screw hole in an end thereof.

Other objects, advantages and novel features of the invention will become more apparent from the following detailed description when taken in conjunction with the accompanying drawings.

DETAILED DESCRIPTION OF THE PREFERRED EMBODIMENT OF THE INVNETION

Reference will now be made to the drawings to describe the present invention in detail.

Figure 1:
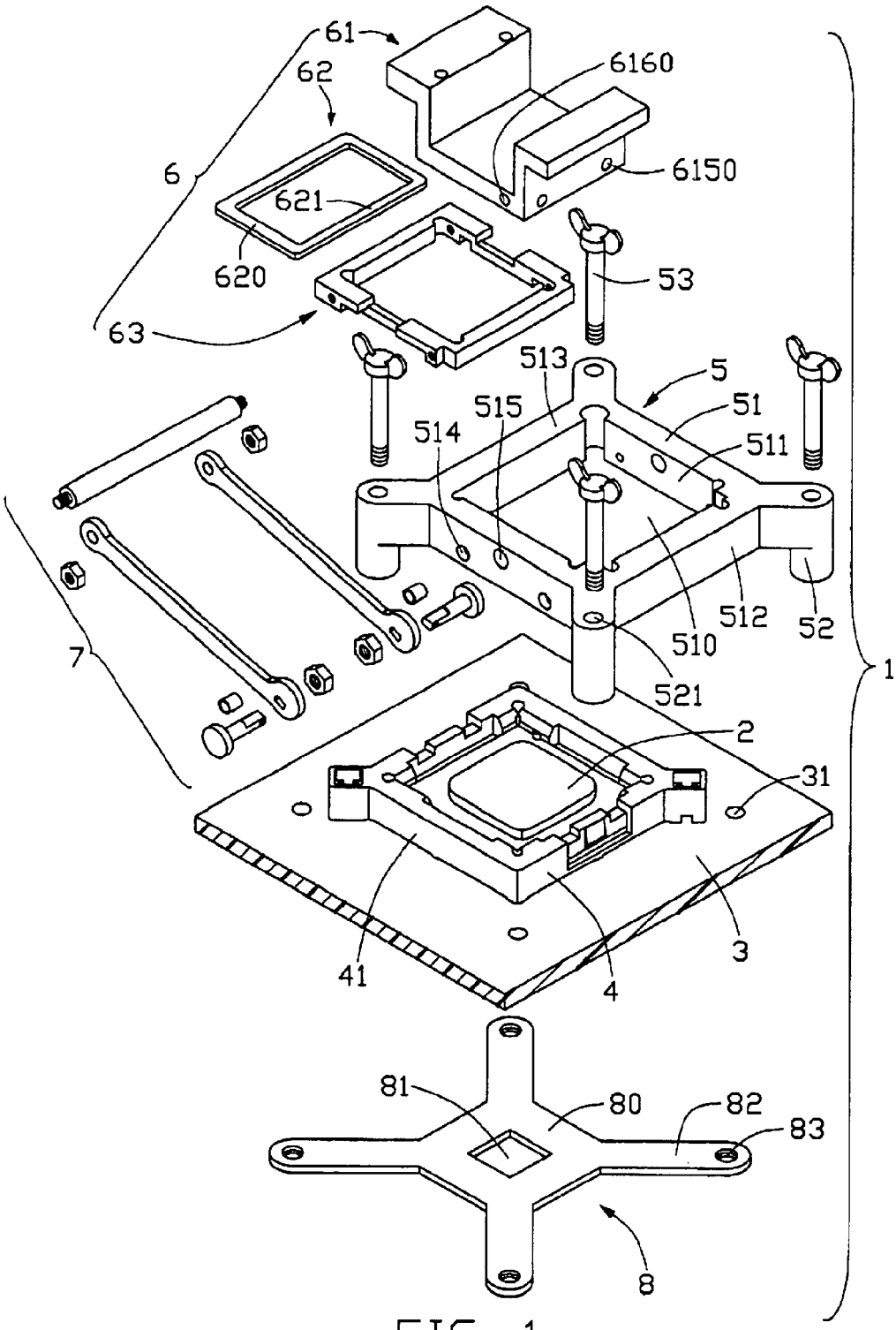
FIG. 1 is an exploded, isometric view of an IC socket assembly in accordance with the preferred embodiment of the present invention, wherein the IC socket assembly comprises an IC socket, a supporting member, a heat sink, an actuation member, and a supporting plate.

Referring to FIG. 1, there is shown an exploded, isometric view of an integrated circuit (IC) socket assembly 1 provided by the present invention. The IC socket assembly 1 is used in electrically connecting an electronic package such as an IC 2 with a substrate circuit such as a burn-in board 3. The IC socket assembly 1 comprises an IC socket 4, a supporting member 5, a heat sink 6, an actuation member 7, and a supporting plate 8.

The IC socket 4 is mounted onto and electrically connected with the burn-in board 3. The IC socket 4 comprises an insulative housing 41, and a number of electrical terminals (not shown) accommodated in the housing 41. The housing 41 defines a cavity (not labeled) in a middle portion thereof, and a corresponding number of receiving cells (not shown) in a portion thereof under the cavity. The IC 2 is received in the cavity, and the number of terminals is accommodated in the receiving cells respectively. Each terminal has a first contact portion extending out of a top of the housing 41 for electrically contacting the IC 2, and a second contact portion extending out of a bottom of the housing 41 for electrically connecting with the burn-in board 3. The burn-in board 3 defines four bores 31, near to four corners of the IC socket 4.

The supporting member 5 comprises a receiving portion 51 and four supporting portions 52 extending from four corners of the receiving portion 51 respectively. The receiving portion 51 comprising a pair of lateral walls 511, and a front wall 512 and a rear wall 513. The front and rear walls 512, 513 interconnect ends of the lateral walls 511, thereby defining a generally rectangular window 510 therebetween. Each lateral wall 511 defines a pair of stepped holes 514 in two opposite ends thereof, and a receiving hole 515 in a portion thereof between the stepped holes 514. A height of the supporting portions 52 is greater than a height of the receiving portion 51. Each supporting portion 52 defines a passageway 521 in a center extending therethrough.

Figure 2:
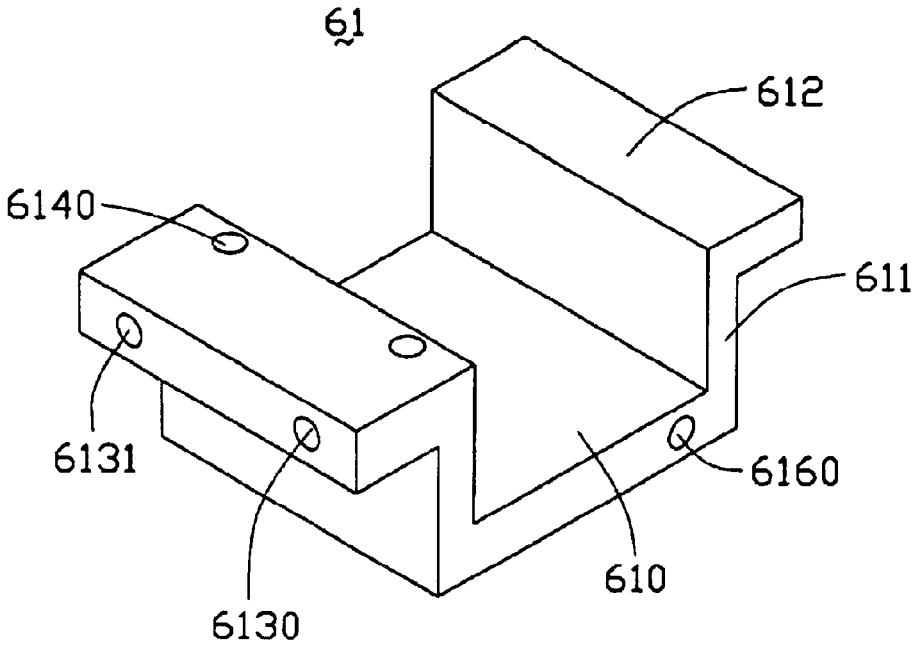
FIG. 2 is an enlarged, isometric view of a jacket of the heat sink of the IC socket assembly of FIG. 1.
Figure 3:
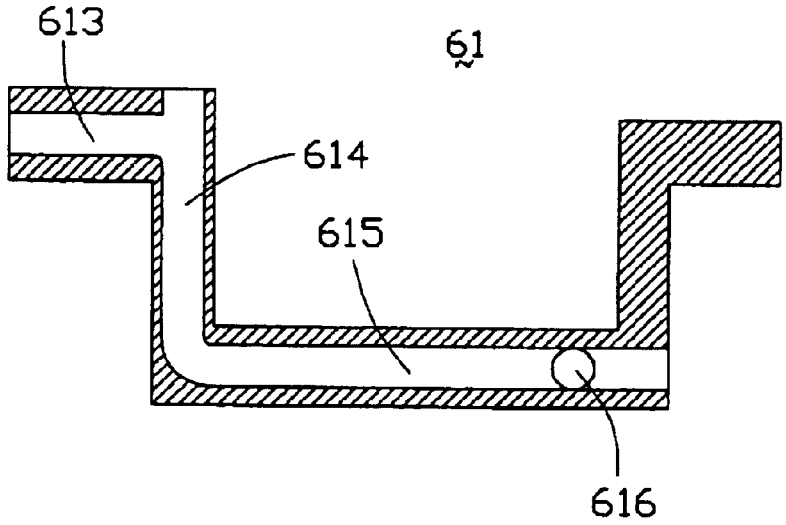
FIG. 3 is a cross-sectional view of the jacket of FIG. 2.
Figure 4:
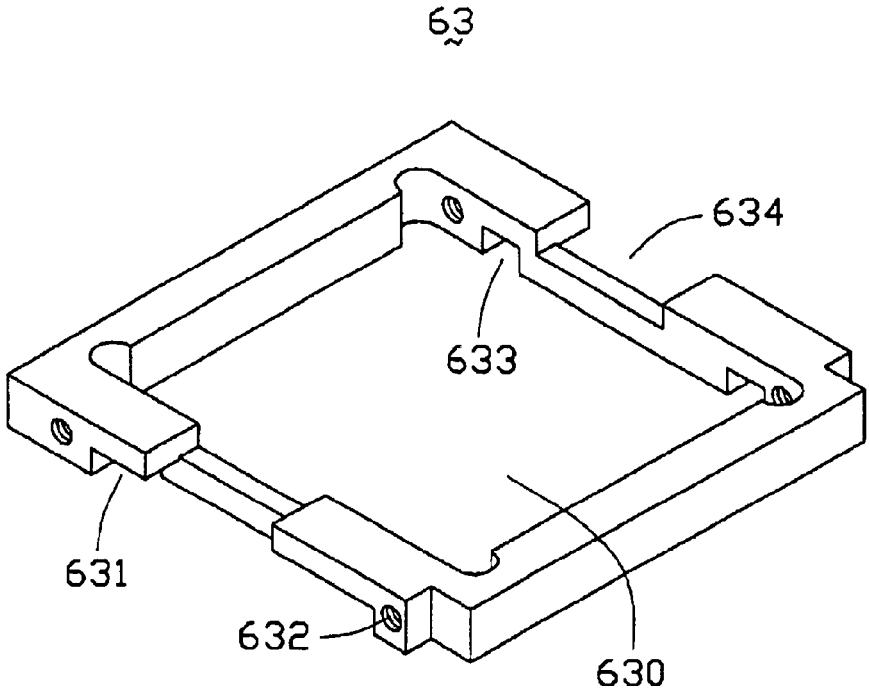
FIG. 4 is an enlarged, isometric view of a frame of the heat sink of the IC socket assembly of FIG. 1.

The heat sink 6 comprises a jacket 61, a spring 62 and a frame 63. Also referring to FIGS. 2 and 3, the jacket 61 comprises a pressing portion 610, a pair of lateral portions 611 extending perpendicularly from ends of the pressing portion 610 respectively, a pair of wings 612 extending perpendicularly from ends of the lateral portions 611 respectively. One of the wings 612 defines a pair of parallel first passages 613. The first passages 613 form an entry 6130 and an exit 6131. One of the lateral portions 611 defines a pair of parallel second passages 614, the second passages 614 in communication with the first passages 613 respectively. The second passages 614 form a pair of gates 6140, the gates 6140 stopped in use. The pressing portion 610 defines a pair of parallel third passages 615 communicating with the second passages 611, and a fourth passage 616 communicating with ends of the third passages 615. The third passages 615 form a pair of gates 6150, the gates 6150 stopped in use. The fourth passage 616 forms a pair of gates 6160, the gates 6160 topped in use. The first, second, third and fourth passages 613, 614, 615, 616 form a U-shaped channel for containing cooling liquid such as water. The spring 62 comprises a pair of parallel short bars 620 and a pair of parallel long bars 621 interconnecting ends of the short bars 620 respectively. Referring to FIG. 4, the frame is generally rectangular, defining an open 630 in a middle portion thereof. Each lateral side wall of the frame defines a pair of screw holes 632 in two opposite end thereof, a cavity 631 in a portion between the screw holes 632, a pair of rectangular hollows 633 in a portion thereof adjacent the cavity 631, and a recess 634 in a portion above the cavity 631. The hollows 633 communicate with the cavity 631.

Figure 5:
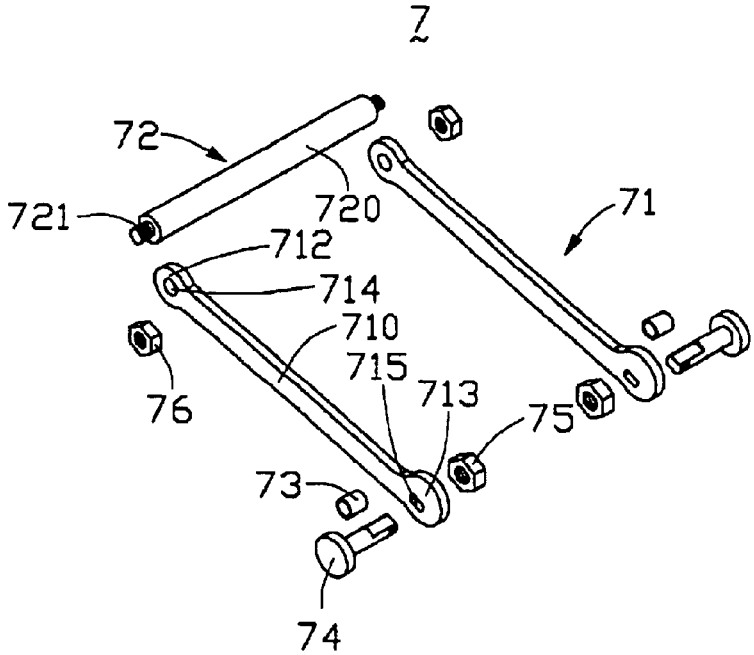
FIG. 5 is an isometric view of the actuation member of the IC socket assembly of FIG. 1.

Referring to FIG. 5, the actuation member 7 comprises a pair of driving levers 71, an operating lever 72 mounted to ends of the driving levers 71, and a pair of bushes 73. The operating lever 72 comprises a rod 720 and a pair of screw pins 721 coaxially extending from ends of the rod 720 respectively. Each driving lever 71 comprises a connecting portion 710, a mounting portion 712 formed on an end of the connecting portion 710, and a cam portion 713 formed on an opposite end of the connecting portion 710. The mounting portion 712 defines an aperture 714 in a middle portion thereof. The cam portion 713 defines a slot 715 departing away a center of the cam portion 713.

The supporting plate 8 comprises a base portion 80 and four extending portions 82 extending from four corners of the base portion 80 respectively. The base portion 80 defines a rectangular open 81 in a middle portion thereof. Each extending portion 82 defines a screw hole 83 in an end thereof. Compared with the supporting plate 98 of the inventional IC socket assembly 9, the supporting plate 8 of the present invention has simply configuration, which decreases the cost of manufacturing the supporting plate 8.

Figure 6:
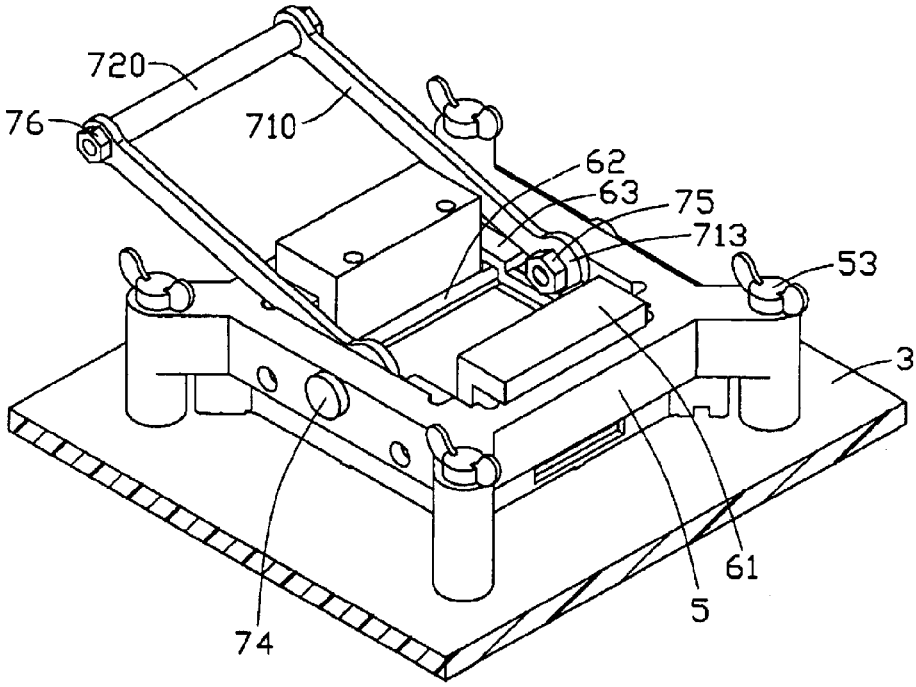
FIG. 6 is an enlarged, assembled view of FIG. 1, showing the actuation member of the IC socket assembly oriented at an open position.

Referring to FIG. 6, in assembly, firstly, the frame 63 of the heat sink 6 is attached around the jacket 61, with bottoms of the wings 612 abutting against a top of the frame 63, and surfaces of the lateral portions 611 abutting against the frame 63. A space is formed between a bottom of the frame 63 and a top surface of the pressing portion 610 of the jacket 6. The spring 62 is received in the space, and the jacket 61 is pushed upwardly. Thus, the short bars 620 of the spring 62 are received in the cavities 631 and abut against the lateral side walls of the frame 63. The long bars 621 of the spring 62 engage in the hollows 633 of the frame 63 and abut against the top surface of the pressing portion 610 of the jacket 61. The assembled heat sink 6 is attached in the window 510 of the supporting member 5, with the stepped holes 514 of the supporting member 5 in communication with the screw holes 632 of the frame 63. Four fasteners, such as screws, pass through the stepped holes 514 of the supporting member 5, and engage in the screw holes 632 of the frame 63, thereby securely assembling the heat sink 6 to the supporting member 5.

Secondly, the cams 713 of the driving levers 71 are received in the recesses 634 of the frame 63 respectively. A bolt 74, around which one of the bushes 73 is attached, passes through one of the receiving holes 515 of the supporting member 5 and the slot 715 of the driving lever 71, and mates with a nut 75. Thus, the driving levers 71 are securely assembled on the supporting member 5, with the cam portions 713 abutting against the short bars 620 of the spring 62. The screw pins 721 of the operating lever 72 engage with the driving levers 71 in the apertures 714 of the driving lever 71, and mates with two nuts 76 in order to secure the operating lever 72 to the driving levers 71.

Thirdly, the assembly consisting of the supporting member 5, the heat sink 6 and the actuation member 7 is put on the top side of the burn-in board 3, with the passageways 521 of the supporting member 5 in communication with the bores 31 of the burn-in board 3. A room is formed between the receiving portion 51 of the supporting member 5 and the burn-in board 3, the room accommodating the IC socket 4. The supporting plate 8 is put on a bottom side of the burn-in board 3 to reinforce the burn-in board 3, with the screw holes 83 of the supporting plate 8 in communication with the bores 31 of the burn-in board 3 and the passageways 521 of the supporting member 5. Four fasteners pass though the passageways 521 of the supporting member 5, the bores 31 of the burn-in board 3, and engage in the screw holes 83 of the supporting plate 8. Thus, the assembly is securely mounted on the burn-in board, with a bottom surface of the pressing portion 610 of the jacket 61 abutting against a top surface of the IC 2. In this embodiment, the fasteners are thumb screws 53 which can be turned with thumb and fingers, so as to decrease the difficulty of assembling the assembly onto the burn-in board 3.

Figure 7:
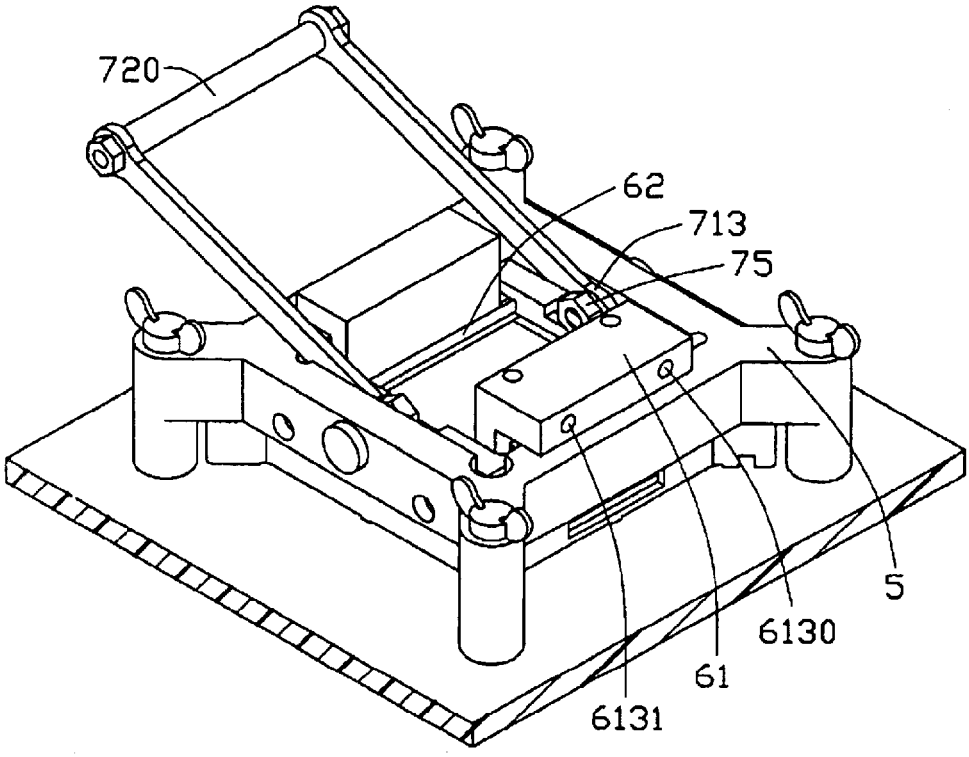
FIG. 7 is similar to FIG. 6, but showing the actuation member oriented at a closed position.
Figure 8:
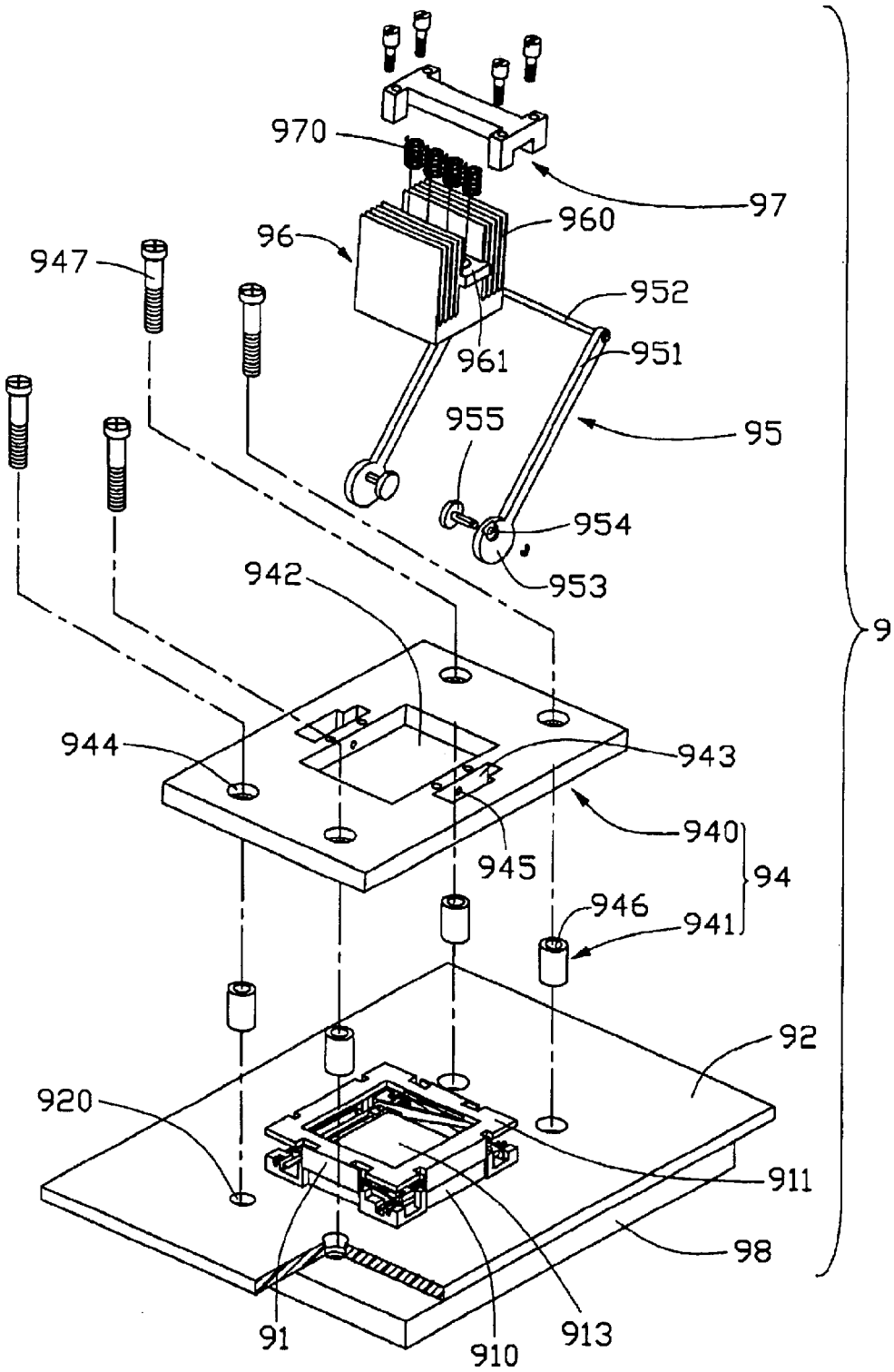
FIG. 8 (PRIOR ART)
FIG. 8 is an exploded, isometric view of a conventional IC socket assembly.
Figure 9:
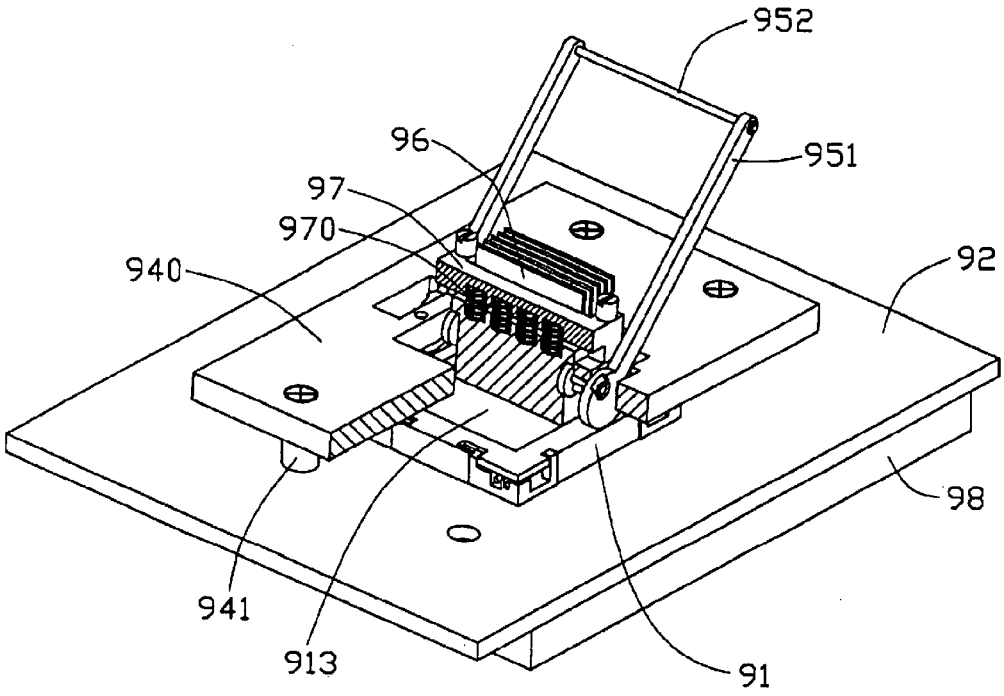
FIG. 9 (PRIOR ART)
FIG. 9 is an enlarged, assembled view of the IC socket assembly of FIG. 8.

Also referring to FIG. 7, in use, the operating lever 72 of the actuation member 7 is rotated from an open position to a closed position. During rotating the actuation member 7, the bolts 74 are receiving in the bushes 73, with lubricant locating therebetween. Thus, the friction between the bolts 74 and the supporting member 5 decreases, which facilitates easy operation of the actuation member 7. In the closed position, the cam portions 713 exert a force upon the short bars 620 of the spring 62, and the long bars 621 of the spring 62 drive the pressing portion 610 of the jacket 61 downwardly. The pressing portion 610 abuts against on a top surface of IC 2 and presses a bottom surface of the IC 2 on the terminals of the IC socket 4, thereby reliably establishing electrical connection between the IC 2 and the burn-in board 3. Two pipes (not shown) are joined with the entry 6130 and the exit 6131 of the jacket 61 respectively.

In this position, the whole assembly can be operated at high temperature for an extended period of time to accelerate potential failure points. During the burn-in, the liquid can be circulated, with flowing into the jacket 61 from the entry 6130 and flowing out of the jacket 61 from the exit 6131. The jacket 61 of the heat sink 6 quickly dissipates heat from the IC 2 and associate components around the IC 2. Therefore, the IC 2 and the associate components can be protected from instability and damage. After the burn-in, the actuation member 7 is rotated from the closed position to the open position, and the thumb screws 53 are turned with thumb and fingers to loose them. The assembly including the supporting member 5, the heat sink 6 and the actuation member 7 are detached from the burn-in board 3. The IC 2 can be easily taken out from the IC socket 4, and a new IC (not shown) can be mounted in the IC socket 4 to be electrically connected with the burn-in board 3.

From the foregoing it will be recognized that the principles of the invention may be employed in various arrangements to obtain the features, advantages and benefits described above. It is to be understood, therefore, that even though numerous characteristics and advantages of the invention have been set forth together with details of the structure and function of the invention, this disclosure is to be considered as illustrative only. Various changes and modification may be made in detail, especially in matters of size, shape and arrangements of parts, without departing from the spirit and scope of the invention as defined by the appended claims.

What is claimed is:

1. An integrated circuit (IC) socket assembly, comprising:

an IC socket mounted on a circuit substrate and receiving an electronic package therein;

a supporting member assembled on the circuit substrate and near the IC socket, the supporting member defining a window in a middle thereof;

a heat sink assembled on the supporting member in the window, the heat sink comprising a jacket attached on the electronic package, the jacket defining a channel for containing cooling liquid; and an actuation member assembled on the supporting member, the actuation member being able to be operated to press the jacket against the electronic package;

a supporting plate assembled on the circuit substrate to reinforce the circuit substrate;

wherein the supporting plate comprises a base portion and four extending portions extending from four corners of the base portion respectively, the base portion defining a rectangular opening in a middle portion thereof and each extending portion defining a screw hole in an end thereof.

2. The IC socket assembly as recited in claim 1, wherein the cooling liquid is water.

3. The IC socket assembly as recited in claim 1, wherein the supporting member comprises a receiving portion and four supporting portions extending from four corners of the receiving portion respectively, the window defined in the receiving portion.

4. The IC socket assembly as recited in claim 3, wherein each supporting portion defines a passageway in a center thereof, and a thumb screw is inserted into the passageway and mates with the supporting plate in one of the screw holes to securely mount the supporting member onto the circuit substrate.

5. The IC socket assembly as recited in claim 1, wherein the heat sink further comprises a frame assembled on the supporting member, and a spring engaging with the frame and abutting against the jacket.

6. The IC socket assembly as recited in claim 1, wherein the heat sink comprises a pressing portion, a pair of lateral portions extending from ends of the pressing portion respectively, a pair of wings extending from ends of the lateral portions respectively, one of the wings defining a pair of parallel first passages, one of the lateral portions defining a pair of second passages communicating with the first passages respectively, and the pressing portion defining a pair of third passages communicating with the second passages and a fourth passage communicating with ends of the third passages.

7. The IC socket assembly as recited in claim 1, wherein the actuation member comprises a pair of driving levers and an operating lever interconnecting ends of the driving levers, each driving lever forming a cam portion on a free end thereof.

8. The IC socket assembly as recited in claim 6, wherein each of the cam portions is securely mounted on the supporting member by a bolt mating in a nut.

9. The IC socket assembly as recited in claim 7, wherein a bush is attached around each of the bolts and in the supporting member.

10. A heat sink assembled near an IC socket which is used for electrically connecting an electronic package with a circuit substrate, the heat sink comprising a jacket attached on the electronic package, the jacket defining a channel for circulating cooling liquid therein to dissipate heat from the electronic package to protect it from instablility and damage;

wherein the jacket comprises a pressing portion, a pair of lateral portions extending perpendicularly from ends of the pressing portion respectively, a pair of wings extending perpendicularly from ends of the lateral portions respectively.

11. The heat sink as recited in claim 10, wherein the cooling liquid is water.

12. The heat sink as recited in claim 10, wherein one of the wings defining a pair of parallel first passages, one of the lateral portions defining a pair of parallel second passages communicating with the first passages respectively, and the pressing portion defining a pair of parallel third passages communicating with the second passages, and a fourth passage communicating with ends of the third passages, thereby forming the U-shaped channel.

13. The heat sink as recited in claim 12, wherein the first passages form an entry and an exit, the water flowing into the jacket from the entry and flowing out of the jacket from the exit.

* * * * *